US012612144B1

(12) United States Patent
Kalnins et al.

(10) Patent No.: US 12,612,144 B1
(45) Date of Patent: Apr. 28, 2026

(54) ELECTRIC MARINE PROPULSION SYSTEM AND CONTROL METHOD

(71) Applicant: Brunswick Corporation, Mettawa, IL (US)

(72) Inventors: Jared D. Kalnins, Neenah, WI (US); Mitchell J. Baer, Fond du Lac, WI (US); Lukas G. Neveau, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 363 days.

(21) Appl. No.: 18/334,476

(22) Filed: Jun. 14, 2023

(51) Int. Cl.
*B63H 21/17* (2006.01)
*B63H 21/21* (2006.01)

(52) U.S. Cl.
CPC ..... *B63H 21/17* (2013.01); *B63H 21/21* (2013.01); *B63H 2021/216* (2013.01)

(58) Field of Classification Search
CPC ..... B63H 21/17; B63H 2021/171; B63H 2021/173; B63H 21/21; B63H 2021/216; G05D 1/00
See application file for complete search history.

(56) References Cited

U.S. PATENT DOCUMENTS 6,507,164 B1 1/2003 Healey et al.
6,652,330 B1 11/2003 Wasilewski
6,885,919 B1 4/2005 Wyant et al.
6,902,446 B1 6/2005 Healey
7,218,118 B1 5/2007 Gonring
7,385,365 B2 6/2008 Feick
8,608,521 B1 * 12/2013 Snyder ..... B63H 21/20 440/6
8,682,516 B1 * 3/2014 Balogh ..... B63H 21/22 33/232
8,836,544 B1 * 9/2014 Balogh ..... B60K 35/215 340/459
9,360,336 B2 * 6/2016 Hoesterei ..... G01C 21/3697
10,343,759 B2 * 7/2019 Despineux ..... B63H 21/213
(Continued)

FOREIGN PATENT DOCUMENTS

CN 119037170 A * 11/2024 ..... B60L 58/10
JP 2009214588 A * 9/2009
KR 102748879 B1 * 1/2025 ..... G06Q 50/10

OTHER PUBLICATIONS

CN-119037170-A machine translation (Year: 2024).*
(Continued)

*Primary Examiner* — Angelina M Shudy
(74) *Attorney, Agent, or Firm* — Andrus Intellectual Property Law, LLP

(57) ABSTRACT

A method of controlling a user interface for an electric marine propulsion system is configured to determine a system power limit based on charge levels of each of the plurality of batteries, control the at least one electric motor of a marine drive in the electric marine propulsion system so that the system power limit is not exceeded, activate an imbalance limit alert when the system power limit for the plurality of batteries is less than a threshold power output for the at least one electric motor or a number of active batteries available to provide power output to the at least one electric motor is less than all of the plurality of batteries, and control a user interface device based on the imbalance limit alert.

21 Claims, 13 Drawing Sheets

(56) References Cited

U.S. PATENT DOCUMENTS 10,384,757 B2 * 8/2019 Mueller ..... B63H 21/213
11,101,678 B2 * 8/2021 Sato ..... G06F 9/3004
11,628,741 B2 * 4/2023 Basler ..... G01R 31/392 701/31.9
12,030,608 B2 * 7/2024 Kirchhoff ..... B63H 21/17
12,060,143 B2 * 8/2024 Janeczko ..... B63H 21/17
12,071,213 B1 * 8/2024 Gonring ..... B63H 21/21
12,103,652 B2 * 10/2024 Jesewitz ..... B63H 21/17
2002/0157883 A1 * 10/2002 Ogata ..... B60W 20/00 180/65.245
2007/0152626 A1 * 7/2007 Boebel ..... B63H 21/17 320/104
2007/0155256 A1 * 7/2007 Boebel ..... B63H 21/17 440/6
2010/0144219 A1 * 6/2010 Balogh ..... B63H 21/20 192/30 R
2011/0049977 A1 * 3/2011 Onnerud ..... B60L 58/24 307/9.1
2011/0244739 A1 * 10/2011 Daikoku ..... B63H 21/17 440/6
2012/0105001 A1 * 5/2012 Gallegos ..... B60L 53/66 320/109
2014/0021925 A1 * 1/2014 Asakura ..... G01R 31/3648 320/126
2014/0210638 A1 * 7/2014 Gussen ..... B60L 58/14 340/870.09
2015/0307166 A1 * 10/2015 Zhou ..... B63H 21/17 440/6
2016/0202682 A1 * 7/2016 Matsumoto ..... H02J 7/35 700/291
2017/0001534 A1 * 1/2017 Cho ..... B60L 7/18
2018/0057132 A1 * 3/2018 Ward ..... B63H 21/213
2018/0134354 A1 * 5/2018 Suzuki ..... B63H 1/16
2018/0134362 A1 * 5/2018 Despineux ..... B63H 21/213
2018/0281902 A1 * 10/2018 Borton ..... H02K 7/14
2018/0294658 A1 * 10/2018 Luan ..... H02J 7/00304
2019/0293721 A1 * 9/2019 Tsutsumi ..... G01R 31/382
2019/0300132 A1 * 10/2019 Kinomoto ..... B63B 34/10
2020/0009988 A1 * 1/2020 Basler ..... H01M 10/48
2020/0164763 A1 * 5/2020 Holme ..... B60L 58/16
2021/0070413 A1 * 3/2021 Gulliksson ..... B63B 34/70
2021/0276686 A1 * 9/2021 Miyagi ..... B63H 21/21
2022/0073179 A1 * 3/2022 Hayashi ..... B60L 1/00
2022/0177096 A1 * 6/2022 Morimoto ..... B63H 21/17
2022/0194542 A1 * 6/2022 Kirchhoff ..... B63H 21/21
2022/0214171 A1 * 7/2022 Johnson ..... B60L 50/60
2022/0242213 A1 * 8/2022 Bartz ..... B60K 26/02
2022/0352559 A1 * 11/2022 Aoki ..... H01M 50/296
2023/0139789 A1 * 5/2023 Ikegaya ..... B63H 21/21 440/1
2023/0174215 A1 * 6/2023 Gonring ..... B63H 20/00 440/6
2023/0175447 A1 * 6/2023 Gonring ..... F02P 5/15 701/21
2023/0294521 A1 * 9/2023 Kalnins ..... B60L 58/14 701/22
2024/0116393 A1 * 4/2024 Saito ..... B60L 53/67
2024/0132190 A1 * 4/2024 Ikegaya ..... B63H 21/21
2024/0383374 A1 * 11/2024 Lee ..... B60L 3/0046
2025/0105642 A1 * 3/2025 Li ..... H02J 7/0014
2025/0191427 A1 * 6/2025 Nakamura ..... G07C 5/10

OTHER PUBLICATIONS

KR-102748879-B1 machine translation (Year: 2025).*
JP-2009214588-A machien translation (Year: 2009).*
Torqeedo GmbH, Travel 503, 1003 S/L, 1003, 1103 CS/CL, https://media.torqeedo.com/downloads/manuals/torqeedo-Travel-manual-DE-EN.pdf, p. 82, accessed Jan. 4, 2022.

* cited by examiner

ELECTRIC MARINE PROPULSION SYSTEM AND CONTROL METHOD

FIELD

The present disclosure generally relates to marine propulsion systems, and more particularly to electric marine propulsion systems having electric motors and methods for controlling power utilization thereof and communicating power utilization constraints to an operator.

BACKGROUND

The following U.S. Patents provide background information and are incorporated herein by reference, in entirety.

U.S. Pat. No. 6,507,164 discloses a trolling motor having current-based power management including: an electric motor; a motor controller having an output for providing voltage to the motor; and a current sensor for measuring the electrical current flowing through the motor. Upon determining that the trolling motor has been operating above its continuous duty limit for a predetermined period of time, the motor controller begins reducing the voltage output to the motor until reaching an acceptable output voltage. In another embodiment, the controller is operated in three distinct modes with three distinct sets of operating parameters, namely: a normal mode wherein the output is set to a commanded level; a current limit mode wherein the output is set to a safe, predetermined level; and a transitional mode wherein the output is incrementally changed from the predetermined level to the commanded level.

U.S. Pat. No. 7,218,118 discloses a method for monitoring the condition of a battery of a marine propulsion system provides the measuring of a voltage characteristic of the battery, comparing the voltage characteristic to a preselected threshold value, and evaluating the condition of the battery as a function of the relative magnitudes of the voltage characteristic and the threshold value. The voltage characteristic of the battery is measured subsequent to a connection event when a connection relationship between the battery and an electrical load is changed. The electrical load is typically a starter motor which is connected in torque transmitting relation with an internal combustion engine. The voltage characteristic is preferably measured at its minimum value during the inrush current episode immediately prior to cranking the internal combustion engine shaft to start the engine.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one aspect of the disclosure, an electric marine propulsion system is configured to propel a marine vessel. The electric marine propulsion system includes a power storage system comprising a plurality of batteries, at least one electric motor powered by the power storage system and configured to rotate a propulsor to propel the marine vessel, and a control system. The control system is configured to identify which of the plurality of batteries are active batteries available to provide power output to the at least one electric motor, determine a system power limit based on the active batteries, determine whether the system power limit is less than a threshold power output for the at least one electric motor, and determine whether a number of active batteries is less than all of the plurality of batteries. If the system power limit is less than the threshold power output for the at least one electric motor and/or the number of active batteries is less than all of the plurality of batteries, then an imbalance limit alert is activated and a user interface is controlled based on the imbalance alert.

In one embodiment, the threshold power output is based on the rated max power for the at least one electric motor, such as at or slightly less than the rated max power.

In one embodiment, controlling the user interface device based on the imbalance limit alert includes controlling a display device to generate a visual imbalance alert. Optionally, controlling the display to generate the visual imbalance alert includes illuminating an imbalance limit indicator light while the imbalance limit alert is active.

In another embodiment, the control system is further configured to generate the visual imbalance alert based on the system power limit to visually indicate the system power limit.

In another embodiment, the control system is further configured to generate the visual imbalance alert based on the number of active batteries to visually indicate the number of active batteries.

In another embodiment, the control system is further configured to identify a maximum voltage level of the plurality of batteries, and wherein identifying the active batteries includes identifying which of the plurality of batteries has a voltage level within a threshold voltage value of the maximum voltage level.

In another aspect of the disclosure, a control method is provided for controlling an electric marine propulsion system that includes a plurality of batteries and at least one electric motor powered by the plurality of batteries and configured to rotate a propulsor to propel a marine vessel. The method includes identifying which of the plurality of batteries are active batteries available to provide power output to the at least one electric motor, determining a system power limit based on the active batteries, determining whether the system power limit is less than a threshold power output for the at least one electric motor, and determining whether a number of active batteries is less than all of the plurality of batteries. If the system power limit is less than the threshold power output for the at least one electric motor and/or the number of active batteries is less than all of the plurality of batteries, an imbalance limit alert is activated and a user interface device is controlled based on the imbalance limit alert. In one embodiment, the control method includes deactivating the imbalance limit alert when currents supplied by each of at least two of the active batteries are within a threshold current tolerance of one another.

In another embodiment, the control method includes determining the threshold current tolerance based on the number of active batteries.

In yet another embodiment, the threshold current tolerance is a percentage of the highest current output supplied by one of the active batteries.

In yet another aspect of the disclosure, a method of controlling a user interface for an electric marine propulsion system is configured to determine a system power limit based on charge levels of each of the plurality of batteries, control the at least one electric motor of a marine drive in the propulsion system so that the system power limit is not exceeded, activate an imbalance limit alert when the system power limit for the plurality of batteries is less than a threshold power output for the at least one electric motor or a number of active batteries available to provide power output to the at least one electric motor is less than all of the plurality of batteries, and control a user interface device based on the imbalance limit alert.

In one embodiment, the threshold power output is based on the rated max power for the at least one electric motor, such as at or slightly less than the rated max power.

In another embodiment, the method includes deactivating the imbalance limit alert when currents supplied by each of at least two of the active batteries are within a threshold current tolerance of one another or when a total power output of the active batteries is within a threshold of the threshold power output for the at least one electric motor.

In another embodiment, the method includes only activating the imbalance limit alert when the system power limit for the plurality of batteries is less than the threshold power output for the at least one electric motor and the number of active batteries available to provide power output to the at least one electric motor is less than all of the plurality of batteries.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
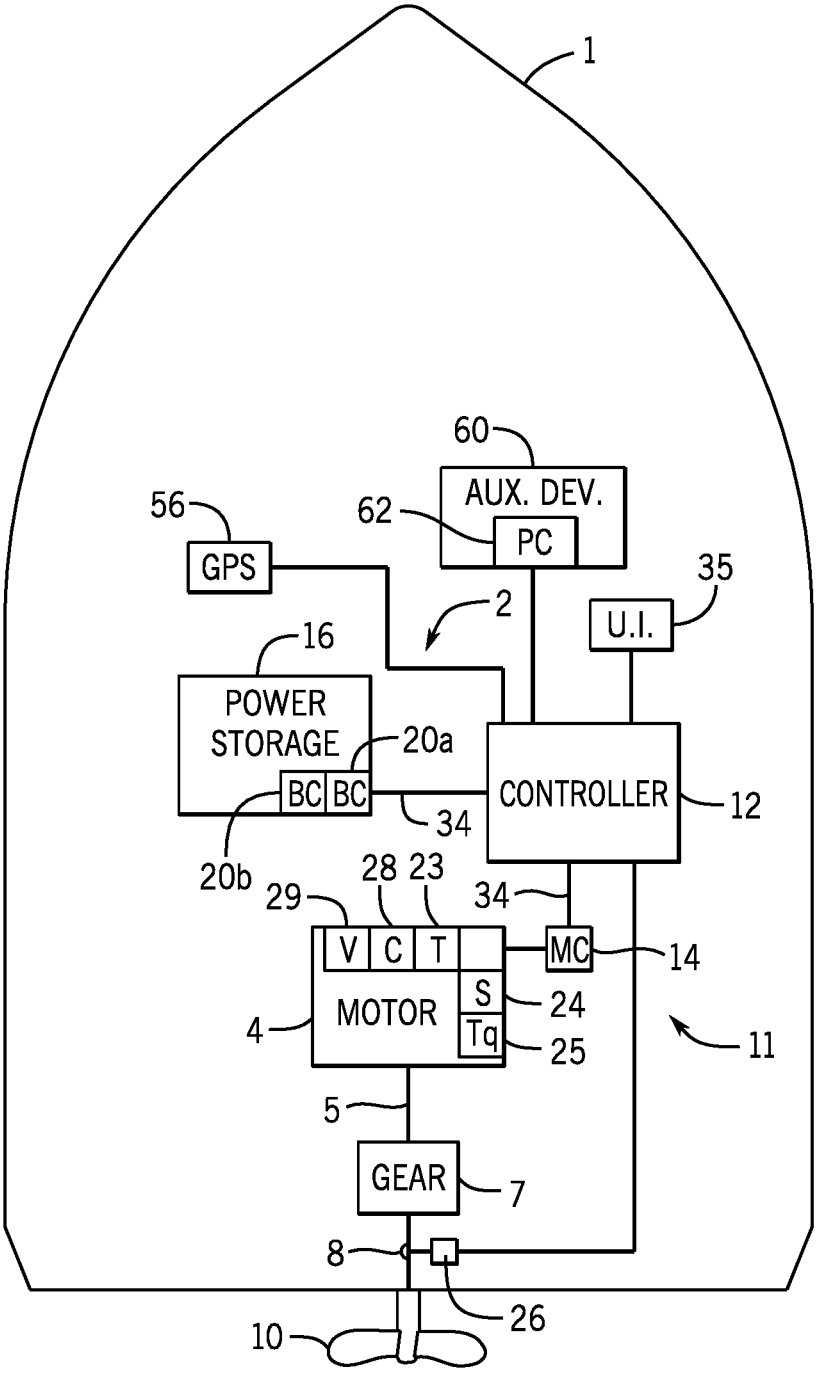
FIG. 1 is a schematic depiction of a marine vessel having an exemplary electric marine propulsion system in accordance with the present disclosure.

The inventors have endeavored to design an electric marine propulsion system with a modular power storage system where customers have the ability to add and remove batteries to increase the power storage capabilities and extend the range of the propulsion system. In doing so, the inventors have recognized a problem with electric marine propulsion systems having a plurality of separately controlled batteries where charge level imbalances or differing conditions across the batteries leads to an overdraw of power from one or a subset of the plurality of batteries. For example, when batteries are connected in parallel to power one or more electric motors power will be drawn generally equally from all available batteries. Where one or more of the batteries has a significantly lower available power limit than the others, such as due to a lower state of charge and/or a high battery temperature, that power limit will be the first to be exceeded as power demanded by the electric motor(s) is increased. Such overdraw can overheat and otherwise degrade the batteries, and also leads to suboptimal system performance, decreased battery state of health, and shortened battery life.

In view of the foregoing challenges relating to power management for electric marine propulsion systems, the inventors developed the disclosed system and method for managing power drawn by propulsion devices from a power storage system comprising a plurality of batteries, such as two or more batteries connected in parallel. The system is configured to identify which batteries in the power storage system are active and should be utilized, and to determine a system power limit based on the active batteries with the lowest power limit(s) so that no battery will be overdrawn. The electric motor(s) are then controlled so that the system power limit is not exceeded, and thus to keep each active battery under its respective power limit so that the power draw by the propulsion system does not overtax or damage any of the plurality of batteries in the power storage system.

The inventors have further recognized that a problem exists where users may assume, upon connection of a plurality of batteries, that all batteries are contributing and that the marine drive(s) will be fully powered. However, as explained herein, the inventors have developed a system wherein power limits are implemented when a power imbalance exists between two or more batteries in a multi-battery system. The inventors have further recognized that a user interface system and control method are needed to strategically convey to the user that a power limit is active when the limit may impact the operator's authority to achieve full propulsion output. Accordingly, the inventors developed the disclosed user interface and control methods to activate and deactivate an imbalance alert, and control a user interface accordingly, to alert a user to the battery charge imbalance and resulting power limit.

In one embodiment, a marine propulsion control system controlling one or more electric marine drives is configured to identify a charge level for each of a plurality of batteries connected to the electric motor, and then to determine which of the plurality of batteries is an active battery based at least in part on the charge level of each of the plurality of batteries. For example, the availability determination may be based on a comparison of all of the battery charge levels and the available batteries may be those with the highest charge levels and/or those within a threshold voltage value of the highest charge level, such as within a threshold difference or within a threshold percent difference. The control system may be configured to identify a minimum power limit for the active batteries, and then determine a system power limit based on the minimum power limit. For example, each battery in the plurality of batteries may include a battery controller configured to determine and provide a power limit for that battery, and a system controller may be configured to identify the minimum power limit as a lower power limit provided from the battery controllers of the active batteries. The system power limit is then determined based on the minimum power limit, such as by multiplying the minimum power limit by the number of active batteries from the power storage system. The electric motor(s) are then controlled so as not to exceed the system power limit, such as by controlling a current draw of the motor(s) such that the total power drawn from the power storage device by the propulsion system (and in some embodiments auxiliary devices as well) does not exceed the limit.

In another embodiment of generating the imbalance limit alert, the disclosed system identifies which of the plurality of batteries are active batteries available to provide power output to the at least one electric motor. For example, the active status of a battery may be determined by identifying the highest battery voltage of all connected batteries and then a subsequent comparison of the remaining connected batteries to the highest voltage. Active batteries are then determined based on the proximity of the charge level of each respective battery to the highest recorded voltage, such as whether the charge level of the respective battery is within a predetermined threshold voltage of the highest voltage value. The system power limit is then determined based on the charge level of the active batteries.

In some embodiments, an imbalance limit alert is generated any time the system power is limited due to a charge imbalance between batteries, such as when one or more batteries is deemed inactive due to a difference in charge level. In other embodiments, once the system power limit is determined, the control system may be configured to assess whether the available power is enough to meet the highest demands of the propulsion system. In one embodiment, the control system determines whether the system power limit is less than a threshold power output for the at least one electric motor and whether the number of active batteries is less than all of the plurality of batteries. If both these conditions are true, the control system generates an imbalance limit alert and controls the user interface device based on the imbalance limit alert until the imbalance limit is deactivated.

Figure 2:
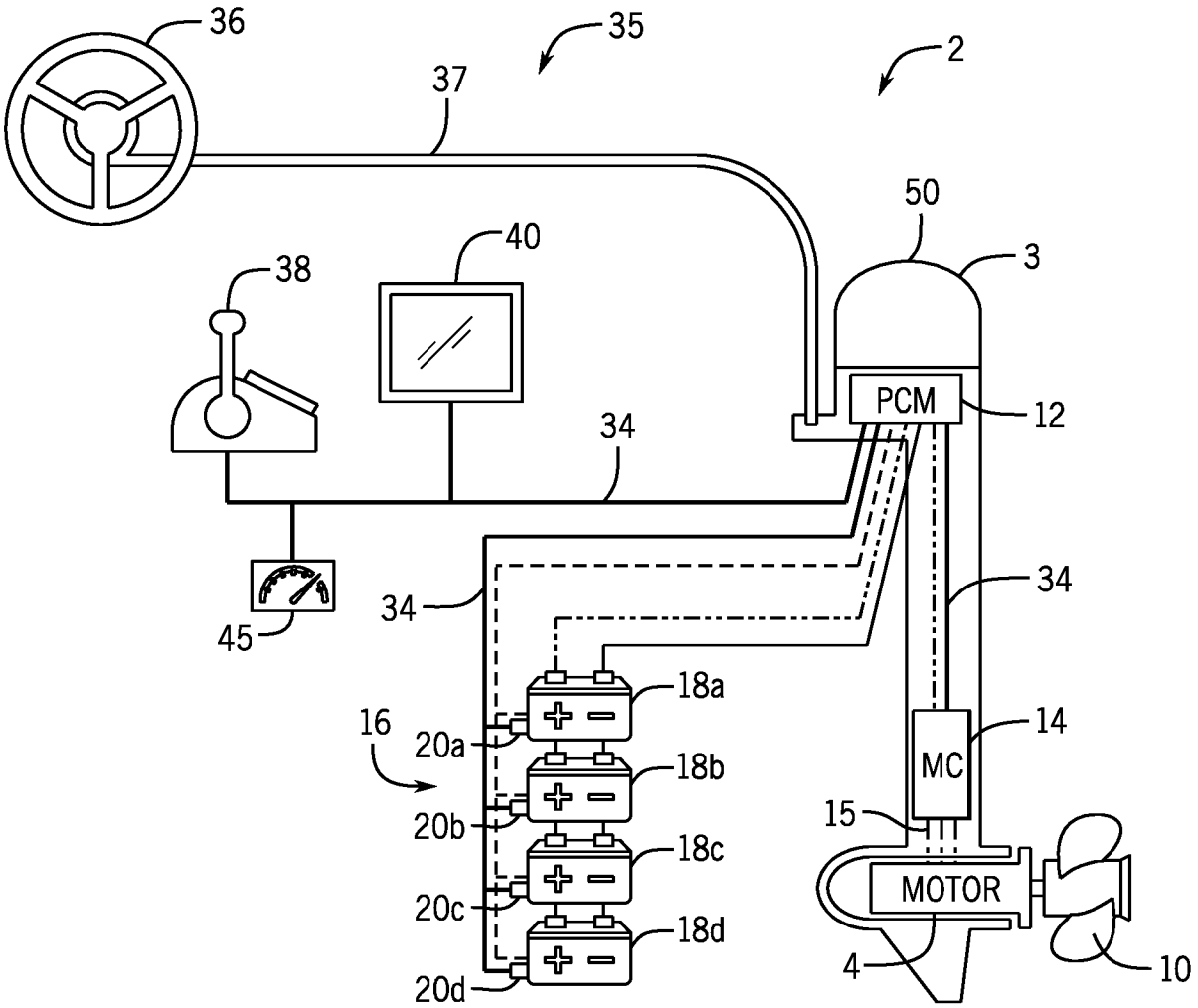
FIG. 2 depicts another exemplary electric marine propulsion system in accordance with the present disclosure.

FIG. 1 depicts an exemplary embodiment of a marine vessel 1 having an electric marine propulsion system 2 configured to propel the marine vessel in a direction instructed by an operator via a steering control system, or by a guidance system configured to automatically control steering of the marine vessel to steer the vessel toward a predetermined location or global position. Referring also to FIG. 2, embodiments of the electric propulsion system 2 include at least one electric marine drive 3 having an electric motor 4 configured to propel the marine vessel 1 by rotating a propeller 10, as well as a power storage system 16, and a user interface system 35. In the depicted embodiment of FIG. 2, the electric marine propulsion system 2 includes an outboard marine drive 3 having an electric motor 4 housed therein, such as housed within the cowl 50 of the outboard marine drive. A person of ordinary skill in the art will understand in view of the present disclosure that the marine propulsion system 2 may include other types of electric marine drives 3, such as inboard drives or stern drives. The electric marine drive 3 is powered by the scalable storage device 16, such as including a plurality of batteries 18 connected in parallel.

The electric marine propulsion system 2 may include one or a plurality of electric marine drives 3, each comprising at least one electric motor 4 configured to rotate a propulsor, or propeller 10. The motor 4 may be, for example, a brushless electric motor, such as a brushless DC motor. In other embodiments, the electric motor may be a DC brushed motor, an AC brushless motor, a direct drive, a permanent magnet synchronous motor, an induction motor, or any other device that converts electric power to rotational motion. In certain embodiments, the electric motor 4 includes a rotor and a stator in a known configuration.

The electric motor 4 is electrically connected to and powered by a power storage system 16. The power storage system 16 stores energy for powering the electric motor 4 and is rechargeable, such as by connection to shore power when the electric motor 4 is not in use. Various power storage devices and systems are known in the relevant art. The power storage system 16 may be a battery system including a plurality of batteries 18 or banks of batteries. For example, the power storage system 16 may include a plurality of lithium-ion (LI) batteries 18, each LI battery 18 comprised of multiple battery cells. In other embodiments, the power storage system 16 may include a plurality of lead-acid batteries 18, fuel cells, flow batteries, ultracapacitors, and/or other devices capable of storing and outputting electric energy.

Each battery 18*a*-18*d* may include an associated battery controller 20*a*-20*d* configured to identify a battery charge level and other battery parameters for that battery, such as battery temperature, and to determine a power limit for that battery based on the charge level (e.g., battery state of charge and/or battery voltage level), battery temperature, battery state of health, etc. Each controller 20*a*-20*d* may also be configured to control whether the respective battery 18*a*-18*d* is connected to deliver power, and thus active, or is inactive and disconnected from and not delivering power to the marine drive(s) 3. For example, if the power limit for the battery 18*a*-18*d* is exceed, such as by a threshold amount or for a threshold period of time, then the controller 20*a*-20*c* may be configured to disconnect the battery 18*a*-18*d* in order to protect it from damage. Where a battery 18*a*-18*d* is in an inactive state, the respective controller 20*a*-20*d* may be configured to communicate a power limit of zero and/or to communicate an error indicating that the battery 18*a*-18*d* is not active or available to provide power.

The electric motor 4 is operably connected to the propeller 10 and configured to rotate the propeller 10. As will be known to the ordinary skilled person in the relevant art, the propeller 10 may include one or more propellers, impellers, or other propulsor devices and that the term "propeller" may be used to refer to all such devices. In certain embodiments, such as that represented in FIG. 1, the electric motor 4 may be connected and configured to rotate the propeller 10 through a gear system 7 or a transmission. In such an embodiment, the gear system 7 translates rotation of the motor output shaft 5 to the propeller shaft 8 to adjust conversion of the rotation and/or to disconnect the propeller shaft 8 from the drive shaft 5, as is sometimes referred to in the art as a "neutral" position where rotation of the drive shaft 5 is not translated to the propeller shaft 8. Various gear systems 7, or transmissions, are well known in the relevant art. In other embodiments, the electric motor 4 may directly connect to the propeller shaft 8 such that rotation of the drive shaft 5 is directly transmitted to the propeller shaft 8 at a constant and fixed ratio.

The power storage system 16 may further include a battery controller 20*a*-20*d* for each battery 18*a*-18*d* in the system, each battery controller 20*a*-20*d* configured to monitor and/or control the respective battery. The battery controller 20*a*-20*d* may be configured to receive information from current, voltage, and/or other sensors within the respective battery 18*a*-18*d*, such as to receive information about the voltage level, current, and temperature of each battery cell or group of battery cells. For example, the battery controller 20*a*-20*d* may receive inputs from one or more sensors, such as one or more voltage, current, and temperature sensors within a housing for the battery 18*a*-18*d*. Voltage sensors may be configured to sense voltage within the battery (such as cell voltage sensors configured to sense the voltage of individual cells or groups of cells in a LI battery) and one or more temperature sensors may be configured to sense a temperature within a housing. The battery controller 20*a*-20*d* is configured to calculate a charge level, such as a state of charge and/or a battery voltage level (such as an open circuit voltage) of the battery 18*a*-18*d*, and may also be configured to determine a battery state of health and a current temperature for the battery 18*a*-18*d*. The battery controller 20*a*-20*d* may be further configured to determine a power limit for the battery 18*a*-18*d*, which is an amount of power that the battery 18*a*-18*d* can supply without overheating, over-discharging, or otherwise compromising the battery. The battery controllers 20*a*-20*d* may be configured to communicate those values via a communication link 34 to other control devices in a control system 11.

A control system 11 controls the electric marine propulsion system 2, wherein the control system 11 may include a plurality of control devices configured to cooperate to provide the method of controlling the electric marine propulsion system described herein. For example, the control system 11 includes a central controller 12, a plurality of battery controllers 20*a*-20*d*, and one or more motor controllers 14, trim controllers, steering controllers, etc. communicatively connected, such as by a communication bus. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected.

Each controller may comprise a processor and a storage device, or memory, configured to store software and/or data utilized for controlling and or tracking operation of the electric propulsion system 2. The memory may include volatile and/or non-volatile systems and may include removable and/or non-removable media implemented in any method or technology for storage of information. The storage media may include non-transitory and/or transitory storage media, including random access memory, read-only memory, or any other medium which can be used to store information and be accessed by an instruction execution system, for example. An input/output (I/O) system provides communication between the control system 11 and peripheral devices.

Each electric motor 4 may be associated with a motor controller 14 configured to control power to the electric motor, such as to the stator winding thereof. The motor controller 14 is configured to control the function and output of the electric motor 4, such as controlling the torque outputted by the motor, the rotational speed of the motor 4, as well as the input current, voltage, and power supplied to and utilized by the motor 4. In one arrangement, the motor controller 14 controls the current delivered to the stator windings via the leads 15, which input electrical energy to the electric motor to induce and control rotation of the rotor.

In certain embodiments, various sensing devices 23-25, 26, and 28-29, may be configured to communicate with a local controller, such as the motor controller 14 or battery controller 20*a*-20*d*, and in other embodiments, the sensors 23-25, 26, and 28-29 may communicate with the central controller 12 and one or more of the motor controller 14 and or battery controller 20*a*-20*d* may be eliminated. A GPS system 55 may also be configured to determine a global position of the vessel, track vessel position over time, and/or determine vessel speed and direction of travel, and to provide such information to the controller 12. Alternatively or additionally, vessel speed may be measured by a speed-over-water sensor such as a pitot tube or a paddle wheel and such information may be provided to the controller 12. Controllers 12, 14, 20*a*-20*d* (and or the various sensors and systems) may be configured to communicate via a communication bus such as a CAN bus or a LIN bus, or by single dedicated communication links between controllers 12, 14, 20*a*-20*d*.

Sensors may be configured to sense the power, including the current and voltage, delivered to the motor 4. For example, a voltage sensor 29 may be configured to sense the input voltage to the motor 4 and a current sensor 28 may be configured to measure input current to the motor 4. Accordingly, power delivered to the motor 4 can be calculated and such value can be used for monitoring and controlling the electric propulsion system 2, including for monitoring and controlling the motor 4. In the depicted example, the current sensor 28 and voltage sensor 29 may be communicatively connected to the motor controller 14 to provide measurement of the voltage supplied to the motor and current supplied to the motor. The motor controller 14 is configured to provide appropriate current and or voltage to meet the demand for controlling the motor 4. For example, a demand input may be received at the motor controller 14 from the central controller 12, such as based on an operator demand at a helm input device, such as the throttle lever 38. In certain embodiments, the motor controller 14, voltage sensor 29, and current sensor 28 may be integrated into a housing of the electric motor 4, in other embodiments the motor controller 14 may be separately housed.

Various other sensors may be configured to measure and report parameters of the electric motor 4. For example, the electric motor 4 may include means for measuring and or determining the torque, rotation speed (motor speed), current, voltage, temperature, vibration, or any other parameter. In the depicted example, the electric motor 4 includes a temperature sensor 23 configured to sense a temperature of the motor 4, a speed sensor 24 configured to measure a rotational speed of the motor 4 (motor RPM), and a torque sensor 25 for measuring the torque output of the motor 4. A propeller speed sensor 26 may be configured to measure a rotational speed of the propeller shaft 8, and thus rotational speed of the propeller 10. For example, the propeller speed sensor 26 and/or the motor speed sensor 24 may be a Hall Effect sensor or other rotation sensor, such as using capacitive or inductive measuring techniques. In certain embodiments, one or more of the parameters, such as the speed, torque, or power to the electric motor 4, may be calculated based on other measured parameters or characteristics. For example, the torque may be calculated based on power characteristics in relation to the rotation speed of the electric motor, for example.

The central controller 12, which in the embodiment shown in FIG. 2 is a propulsion control module (PCM), communicates with the motor controller 14 via communication link 34, such a serial communication bus or other type of communication network (which may be a wired or wireless network implementation). To provide one example, the communication link 34 may be a CAN bus, such as a Kingdom Network. The controller also receives input from and/or communicates with one or more user interface devices in the user interface system 35 via the communication link, which in some embodiments may be the same communication link as utilized for communication between the controllers 12, 14, 20*a*-20*d* or may be a separate communication link. The user interface devices in the exemplary embodiment include a throttle lever 38 and a display 40. In various embodiments, the display 40 may be, for example, part of an onboard management system, such as the VesselView™ by Mercury Marine of Fond du Lac, Wisconsin. A steering wheel 36 is provided, which in some embodiments may also communicate with the controller 12 in order to effectuate steering control over the marine drive 3, which is well-known and typically referred to as steer-by-wire arrangements. In the depicted embodiment, the steering wheel 36 is a steer arrangement where the steering wheel 36 is connected to a steering actuator that steers the marine drive 3 by a steering cable 37. Other steer arrangements, such as various steer-by-wire arrangements, are well-known in the art and could alternatively be implemented.

The various parameters of the electric propulsion system are utilized for providing user-controlled or automatically effectuated vessel power control functionality appropriate for optimizing power usage. The system may be configured to control power usage by the electric propulsion system 2 to prevent overdrawing any one of the plurality of batteries 18*a*-18*d*. In one embodiment, the control system 11 modulates the motor output, such as by controlling the amount of current that the motor 4 is drawing, so that a power limit from any one of the plurality of batteries will not be exceeded. Where the batteries are connected in parallel, modulation of the motor 4 output impacts all the batteries 18*a*-18*d* that are active, and thus available to power the motor 4, and cannot be targeted at only changing the power draw from certain active batteries.

The power storage system 16 may further be configured to power auxiliary devices 60 on the marine vessel 1 that are not part of the propulsion system 2. For example, the auxiliary devices may include a bilge pump, a cabin lights, a stereo system or other entertainment devices on the vessel, a water heater, a refrigerator, an air conditioner or other climate/comfort control devices on the vessel, communication systems, navigation systems, or the like. Some or all of these accessory devices are sometimes referred to as a "house load" and may consume a substantial amount of battery power.

In certain embodiments, the control system 11 may be configured to determine a portion of the load available for propulsion based on the load amount being used by the auxiliary devices, and may be configured to control the motor 4 accordingly so that the total power draw does not exceed the power limit, including the power draw from the propulsion system 2 and from the auxiliary devices 60. The power consumption by some or all of the auxiliary devices may be monitored, such as by one or more power controllers 62 associated with one or a group of auxiliary devices (FIG. 1). The power controller 62 is communicatively connected to the controller 12 or is otherwise communicating with one or more controllers in the control system 11 to communicate information about power consumption by such auxiliary devices. For example, the power controller 62 may be configured to communicate with one or more power monitoring or other control devices via CAN bus or LIN bus. The control system 11 is thus configured to determine an available load that can be used for propulsion by subtracting the auxiliary power draw value representing power drawn by one or more auxiliary devices from the system power limit to determine an available power, where the at least one electric motor is controlled so as not to consume more than the available power.

Alternatively or additionally, the control system 11 may be configured to control power to one or more auxiliary devices in order to enable better power allocation and reserve more power for the propulsion device, such as during periods of high propulsion demand from the user and/or when the available power from the power storage system 16 falls below a threshold. For example, the power consumption by some or all of the auxiliary devices may be controllable by the power controller 62 associated with each controlled auxiliary device or a group of auxiliary devices (FIG. 1). The power controller 62 may be configured to receive instructions from the central controller 12 or other control device(s) in the control system 11 via CAN bus or LIN bus, and to then control operation of the auxiliary device and/or power delivery to the auxiliary device according to received instructions.

For instance, the system may be configured to reduce power delivery to the device(s) 60, or to selectively turn off the auxiliary device(s) 60 by turning on or off power delivery to the device(s) 60 associated with the power controller 62 based on the system power limit and the power needed for propulsion. The power controller 62 may be configured to instruct power-down of the auxiliary device or to otherwise cut power thereto to turn off one or more auxiliary devices 60. Alternatively or additionally, the power controller 62 for one or a set of auxiliary devices may include a battery switch controlling power thereto. The control system 11 may thus include digital switching system configured to control power to the various auxiliary devices, such as a CZone Control and Monitoring system by Power Products, LLC of Menomonee Falls, WI. Other examples of power control arrangements are further exemplified and described at US application Ser. Nos. 17/009,412 and 16/923,866, which are each incorporated herein by reference in its entirety.

The control system 11 may be configured to select certain auxiliary device(s) 60 that get turned off or otherwise controlled to reduce or eliminate power consumption by those device(s). For example, the controller 12 may be configured with a list of one or more auxiliary devices 60 that gets turned off under certain conditions, such as when the available power from the power storage system 16 falls below certain thresholds and/or based on user input indicating a desire from maximizing power available for propulsion. Each power level threshold, for example, may be associated with one or more lists of auxiliary device(s) 60 that gets turned off, and similarly differing lists may be associated with various battery charge levels and/or with various distance error values. For example, the system 11 may be configured to turn off certain non-essential auxiliary devices that are not essential to the operation of the propulsion system when the battery total charge level of the available batteries reaches a low threshold. For example, those devices that are not important for optimized vessel operation, such as entertainment devices or other accessories, or non-essential devices that draw signification power, such as climate control devices and water heaters, may be automatically turned off by the control system or the user interface display may be controlled to instruct a user to turn off one or more of such devices. Similarly, the system may be configured to facilitate user input instructing prioritization of propulsion for power consumption, where power to auxiliary devices 60 is limited based on the amount of power needed to meet user propulsion demand.

Figure 3:
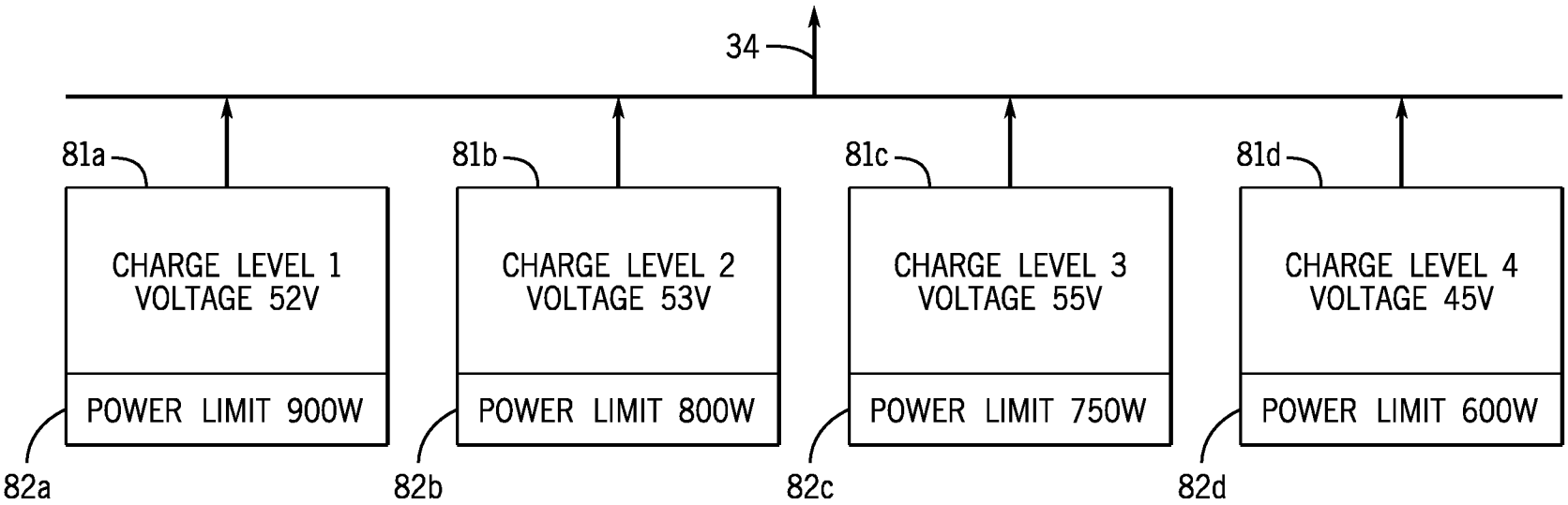
FIG. 3 illustrates a set of charge level and power limits for each of a plurality of batteries in accordance with the present disclosure.
Figure 4:
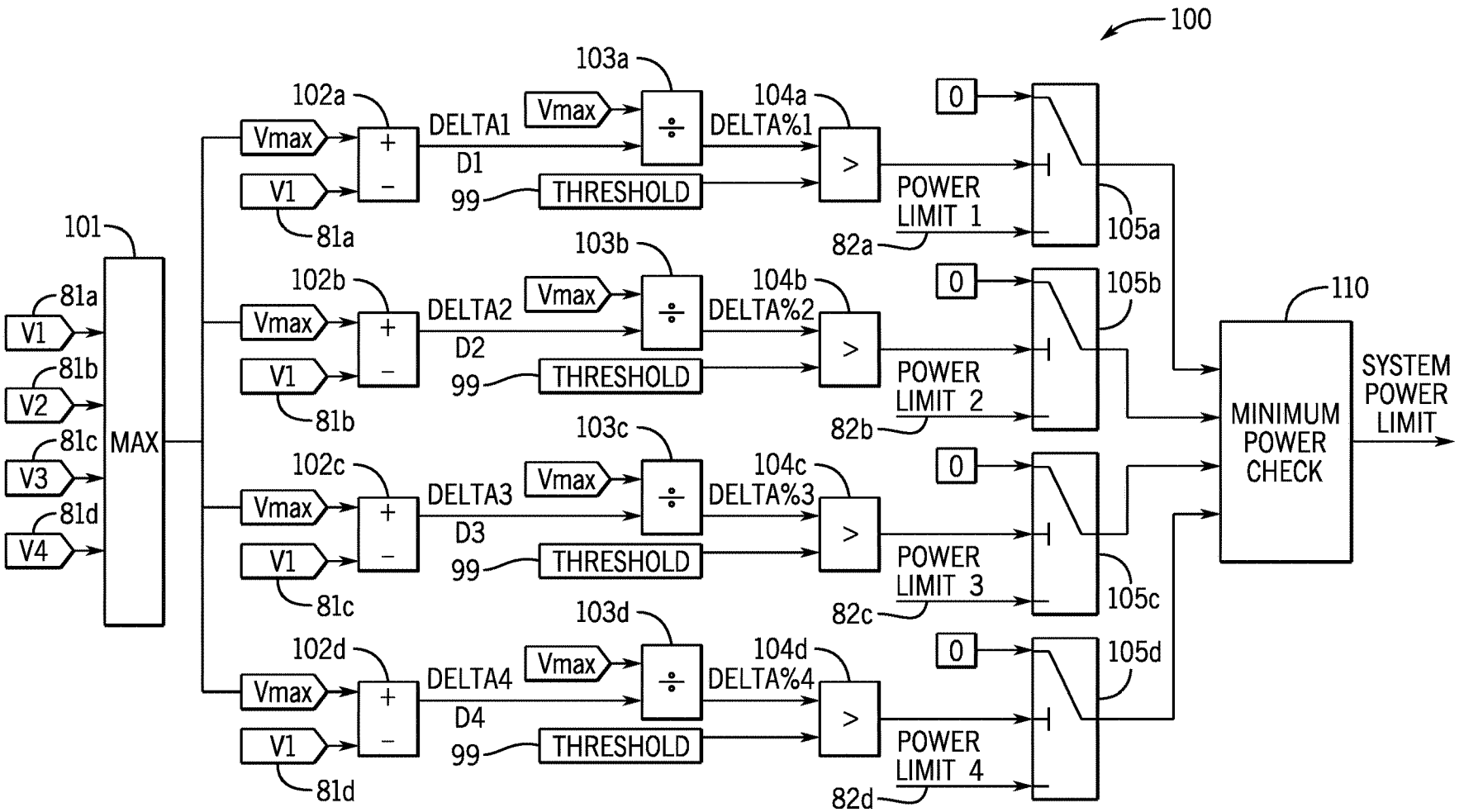
FIGS. 4-5 are control diagrams illustrating exemplary steps for controlling an electric marine propulsion system in accordance with the present disclosure.
Figure 5:
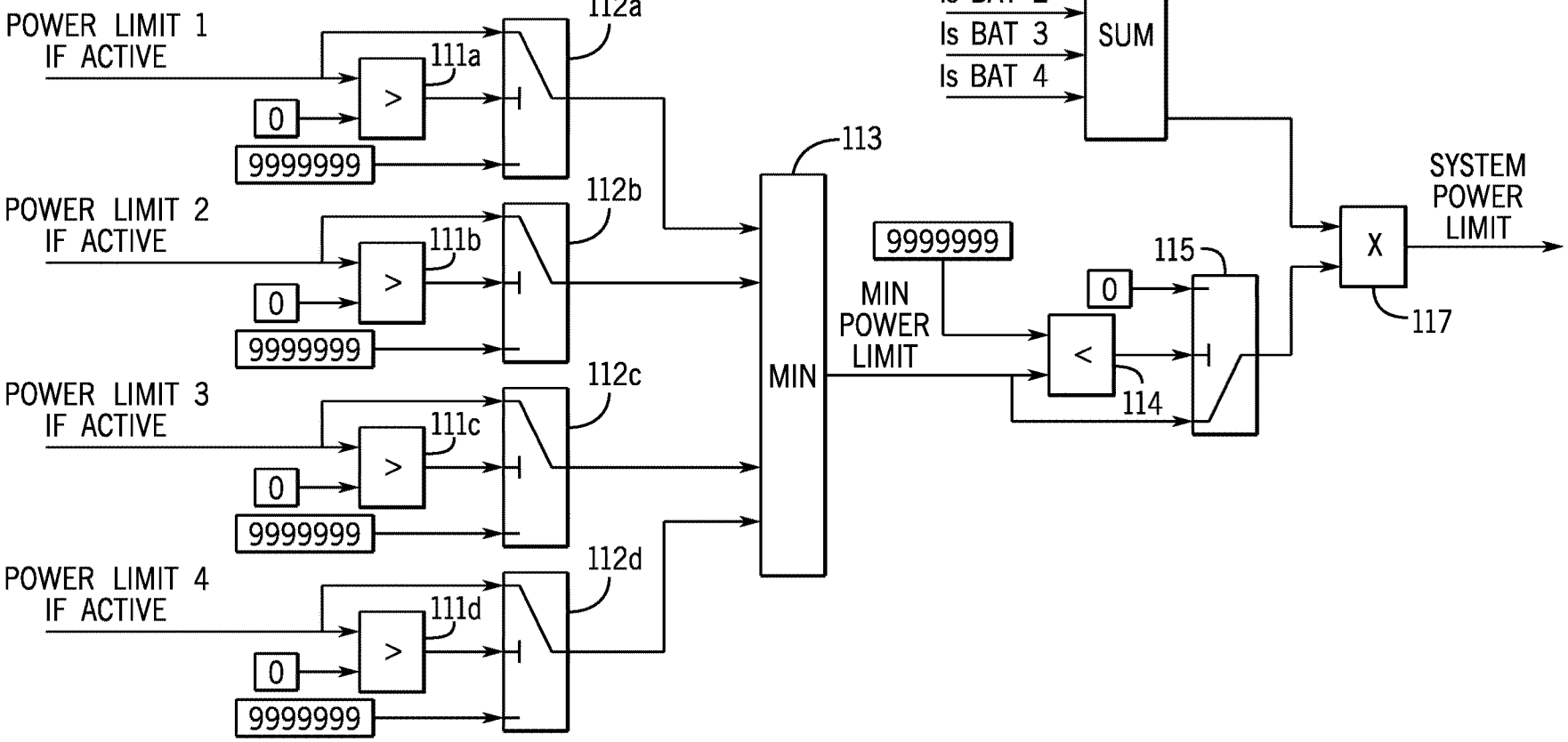

The control diagrams at FIGS. 3-5 illustrate exemplary control routines executed by the control system 11 for controlling the propulsion system 2. FIG. 4 illustrates exemplary battery charge level information and power limit information determined for each of four batteries (e.g., 18*a*-18*d*), such as by battery controllers (e.g., 20*a*-20*d*). A charge level 81*a*-81*d* is determined for each of the four batteries 18*a*-18*d* and communicated via communication link 34, such as to a central controller 12 configured to identify which batteries are active and determine a system power limit accordingly. The charge level 81*a*-81*d* may be a state of charge value, a voltage value (such as an open circuit voltage for the battery), and/or any other value indicating the amount of power stored and available to be supplied by that battery. A power limit value 82*a*-82*d* is also determined for each battery 18*a*-18*d* and communicated along with the charge level information. For example, each battery controller 20*a*-20*d* may be configured to determine the power limit for the respective battery based on the charge level for that battery and other information, including battery temperature. If the battery is running hot, the power limit will be reduced so as to avoid overheating the battery and may be significantly reduced, such as set to zero, if the battery is at severe risk of overheating. Other factors, such as battery state of health, may also impact the power limit determination by each battery controller 20*a*-20*d*.

In the example in FIG. 3, a first charge level 81*a* and a first power limit 82*a* are associated with a first battery 18*a* in the power storage system 16. Similarly, a second charge level 81*b* and a second power limit 82*b* are associated with a second battery 18*b*; a third charge level 81*c* and third power limit 82*c* are associated with a third battery 18*c*; and a fourth charge level 81*d* and fourth power limit 82*d* are associated with a fourth battery 18*d*. The power limit 82*a*-82*c* is determined as a limit on the amount of power that battery can provide, which may be based on one or more of the battery charge level (e.g., battery voltage and/or battery state of charge) and the battery temperature. Battery temperatures of batteries in the storage system 16 may vary from one another, such as based on environmental conditions (e.g., one or a subset of batteries is in the sun or closer to a heat-generating device or system) or conditions of that battery (e.g., being subjected to greater power draw). In the scenario illustrated in FIG. 3, battery 18*c* has the lowest power limit 82*c* despite having a higher charge level 81*c*. This may be due, for example, to environmental temperature conditions or recent power draw conditions of that battery 18*c*. In the depicted example, the charge level values are depicted in volts and the power limit values are depicted in watts; however, these units are merely exemplary and other values and corresponding units of measure may be utilized for the charge level and/or power limit values utilized by the system.

The battery charge levels 81*a*-81*d* and power limits 82*a*-82*d* are provided as inputs to the control method 100 exemplified in FIGS. 4 and 5. In FIG. 4, steps are executed to determine which of the plurality of batteries 18*a*-18*d* are active batteries and then to determine a system power limit based thereon. The charge levels 81*a*-81*d* are assessed to determine a highest charge level at logic step 101, which is the greatest of the charge level values 81*a*-81*d* for the plurality of batteries 18*a*-18*d* in the power storage system 16. In the exemplary battery values shown in FIG. 3, the third charge level 81*c* is the highest charge level, at 55 volts.

The highest charge level, referred to here as Vmax, is provided to logic step 102, where a charge level delta is determined between the highest charge level and the charge level for each battery, respectively. For example, the highest charge level may be the maximum voltage level of the plurality of batteries (e.g., the highest open circuit voltage). A first charge level delta D1 is determined at logic step 102*a* as a difference between Vmax and the first charge level 81*a* for the first battery 18*a*. A second charge level delta D2 is determined at logic step 102*b* as a difference between the highest charge level Vmax and the second charge level 81*b* for the second battery 18*b*. A third charge level delta D3 is determined at logic step 102*c* as a difference between the highest charge level Vmax and the third charge level 81*c* for the third battery 18*c*. A fourth charge level delta D4 is determined at logic step 102*d* as the difference between the highest charge level Vmax and the fourth charge level 81*d* for the fourth battery 18*d*.

Each charge level delta D1-D4 is compared to a threshold delta to determine whether the batteries will be utilized as active batteries or disconnected due to the comparatively low charge level. For example, the threshold delta may be a threshold voltage value, such as a threshold voltage difference or threshold percent difference. In the depicted example, the threshold delta is a percentage value, and thus an initial logic step 103 is executed to determine a percentage value for each of D1-D4. Namely, steps 103*a*-103*d* are executed to divide Vmax by the respective delta value to generate a charge level percent delta for each of the plurality of batteries 18*a*-18*d*. Each charge level percent delta is compared to the predetermined threshold delta 99 at steps 104*a*-104*d*. If the charge level percent delta is less than the threshold delta 99, then the respective battery is determined to be active. If the charge level percent delta is greater than the threshold, then an error is generated and the respective battery is considered inactive. Thus, if the charge level 81*a*-81*d* for each respective battery is close enough to the highest charge level, then the battery is deemed active. If any of the charge levels 81*a*-81*d* is not sufficiently close in value to the highest charge level, and thus the threshold delta is exceeded, then the battery will be deemed inactive and not utilized for determining the power availability from the system and the system power limit. Batteries with charge levels that are significantly below those of other batteries will be turned off and not utilized.

The power limits 82*a*-82*d* are provided and analyzed at logic steps 105*a*-105*d*, where the system is configured to generate a power limit of zero for inactive batteries and pass the respective power limit values 82*a*-82*d* for active batteries. Thus, for any active battery, the power limit will be a non-zero value. For inactive batteries, a zero power limit value is outputted from the respective logic block 105*a*-105*d*. Referring to the exemplary values shown in FIG. 4 to illustrate, the fourth charge level value 81*d* is greater than the threshold delta from the highest charge level, which in the example is third charge level 81*c*, and thus the fourth battery will be determined inactive and a value of zero will be passed at logic step 105*d* rather than passing the fourth power limit value 82*d*. Thus, the fourth power limit value 82*d*, which is the lowest power limit overall, will not be considered when determining the system power limit because, for the time being, that battery will not participate in powering the system. The remaining three power limit values 82*a*-82*c* will be passed, and thus non-zero values will be provided for those three batteries to the system power limit module 110, where steps are executed to determine the system power limit.

FIG. 5 depicts exemplary steps for determining the system power limit, and thus one embodiment of method steps performed by the system power limit module 110. The values determined at steps 105*a*-105*d* are received as inputs, where the power limits 82*a*-82*d* are provided for all active batteries and a zero or null value is provided if the battery is not active. Steps 111*a*-111*d* are a preliminary check for inactive batteries. Where zero or null values are provided, comparative logic step 111*a*-111*d* will generate a false or null value. Where a positive, non-zero power limit value is provided, the corresponding logic step 111*a*-111*d* will generate a true or one value. If the output at step 111*a*-111*d* is true, then the corresponding logic gate 112*a*-112*d* will pass a non-zero positive power limit value. If the output of any of steps 111*a*-111*d* is false, then the corresponding logic gate 112*a*-112*d* will pass a high edge case value, or high placeholder value.

The outputs of logic step 112*a*-112*d* are provided to logic step 113 where a minimum power limit for the active batteries is identified as the lowest input value. Referring again to the exemplary inputs shown in FIG. 3, where the battery associated with power limit 83*d* is determined to be inactive, the first through third power limits 82*a*-82*c* will be assessed at step 113. Power limit 82*c* for the third battery 18*c* is the lowest and thus will be selected as the minimum power limit for the active batteries. As mentioned above, the comparatively low power limit of the third battery 18*c* despite its higher charge level may be due, for example, to comparatively higher environmental temperature conditions for that battery or comparatively high power draw conditions of that battery 18*c* which may cause an increase in the internal temperature of the third battery 18*c*.

Logic steps 114 and 115 are included to ensure that the minimum power limit outputted from step 113 is a real value. If not, logic gate 115 will output zero, and the system power limit will be zero. Otherwise, logic gate 115 will output the minimum power limit. Logic step 116 is configured to determine the number of active batteries. The system power limit is then determined at step 117 by multiplying the minimum power limit by the number of active batteries.

Figure 6:
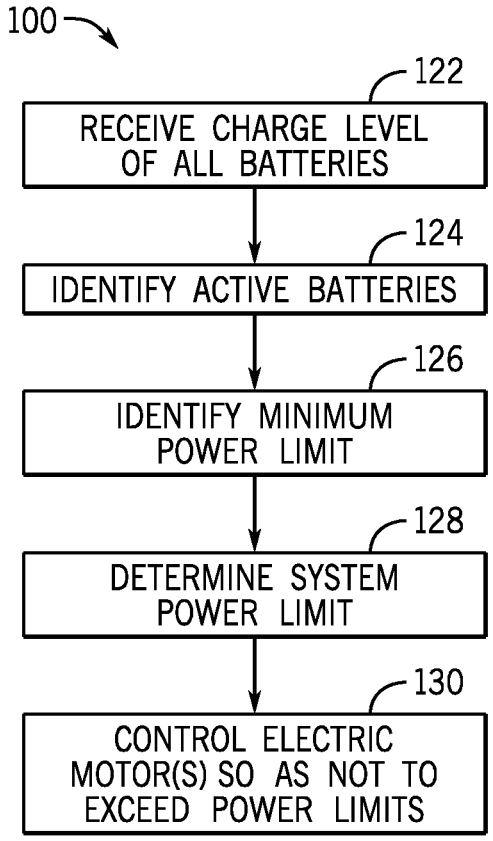
FIG. 6 is a flow chart depicting another exemplary method for controlling an electric marine propulsion system in accordance with the present disclosure.

FIG. 6 is a flow chart depicting an exemplary method 100 for controlling an electric marine propulsion system so as not to exceed a power limit determined as described herein. Charge levels of all batteries in the power storage system 16 are received at step 122. Active batteries are identified from the plurality of batteries (e.g., 18*a*-18*d*) in the power storage system 16 are identified at step 124 based at least in part on the charge level of each of the plurality of batteries. For example, the active batteries may be identified based on a comparison of the charge levels relative to one another, as is described above. The minimum power limit is then identified at step 126, such as the lowest power limit for any one of the active batteries. The system power limit is then determined at step 128 based on the minimum power limit and the number of active batteries to be used to power the electric motor.

The one or more electric motors 4 in the electric marine drives 3 are then controlled at step 130 so as not to exceed the power limit. For example, the motor controller 14 may be configured to limit a power draw, such as by limiting a current draw, from the electric motor 4 so as not to exceed the system power limit. Alternatively, the control system may be configured to impose a demand limit based on the system power limit, where user demand values greater than the demand limit are not effectuated, thereby preventing the system power limit from being exceeded and preventing overdrawing power from any one of the plurality of batteries in the power storage system 16. For example, each calculated system power limit value may be associated with a respective demand limit.

In some embodiments, the control system 11 may be further configured to account for power drawn by one or more auxiliary devices 60 in effectuating the system power limit such that a total power draw by the at least one electric motor and other devices does not exceed the system power limit. For example, the auxiliary power may be subtracted from the system power limit and the at least one electric motor 4 may be controlled so as not to exceed that remaining available power value such that the total power usage by all devices connected to the power storage system 16 does not exceed the system power limit.

As described above, in a multi-battery system with two or more batteries connected in parallel, the charge levels of the batteries 18*a*-*d* at a given time may significantly differ and may lead the system to impose a system power limit based that accommodates the varying charge levels.

The threshold of power output may be determined by which of the plurality of batteries 18*a*-*d* meet a required threshold voltage value and/or a threshold current tolerance, as non-limiting examples. Exemplary methods for determining a system power limit are described herein, although a person of ordinary skill in the art will understand in view of the present disclosure that the disclosed system and method for generating and managing an imbalance limit alert applies to any system power limit implementation based on charge imbalances between batteries 18*a*-*d*. When a power limit is imposed, the total power output available to the propulsion system is reduced from a maximum power output that would otherwise be available, and the limited available power may differ from a user's expectations. Thus, when a power limit is implemented such that it limits the output of the motor below the normal limitations of the rated max power for that motor, then the system operates to generate an imbalance alert via a user interface device to ensure that the user is aware of the system power limit. This prevents or dissuades the user's assumption that, for example, power from all connected batteries are available to the user and alerts the user to the power imbalance between the batteries When there is an imbalance limitation attached to the system power limit, the determination of whether the user is notified of the imbalance via an imbalance limit alert may include assessing whether sufficient power is available operate the electric motor at its rated max power. Alternatively or additionally, the system may be configured to determine when the imbalance alert can be turned off, or deactivated, based on detecting when the system has come into equilibrium close enough for the system to provide full power from all the active batteries or otherwise can provide enough power to operate the electric motor at its rated max power.

Figure 7:
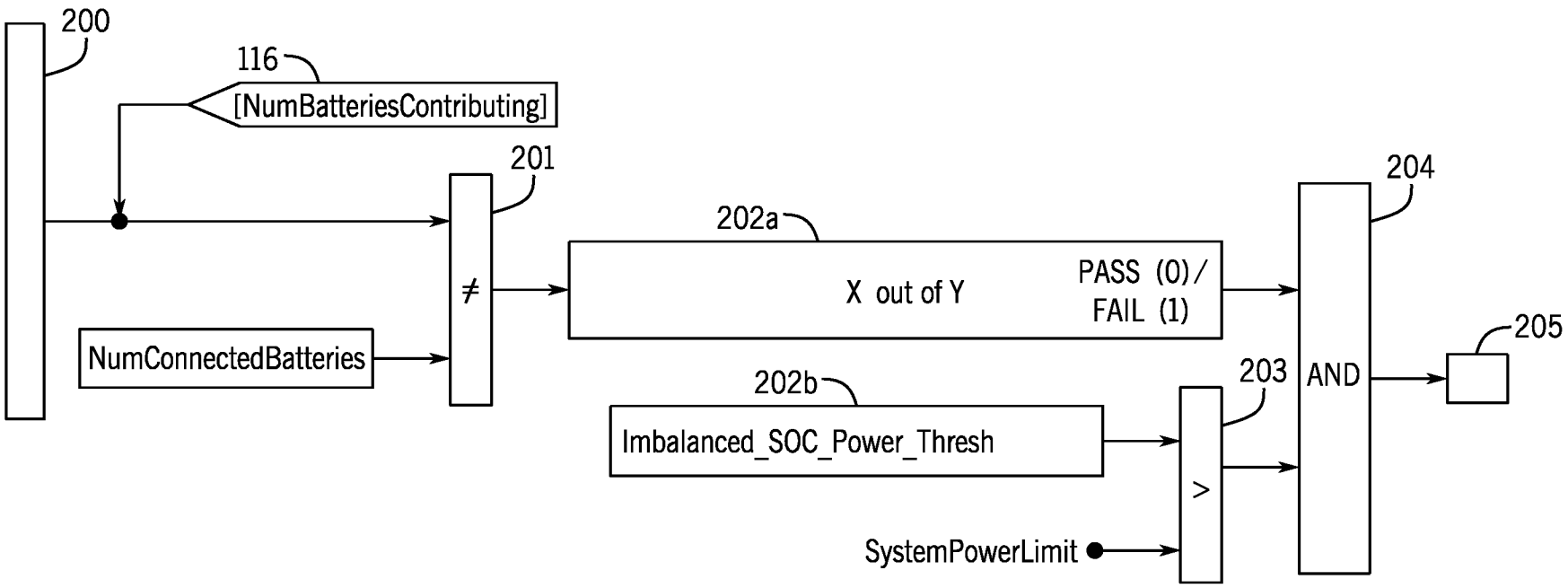
FIG. 7 is a control diagram illustrating exemplary steps for controlling an electric marine propulsion system and user interface therefor in accordance with the present disclosure to activate an imbalance limit alert.
Figure 8:
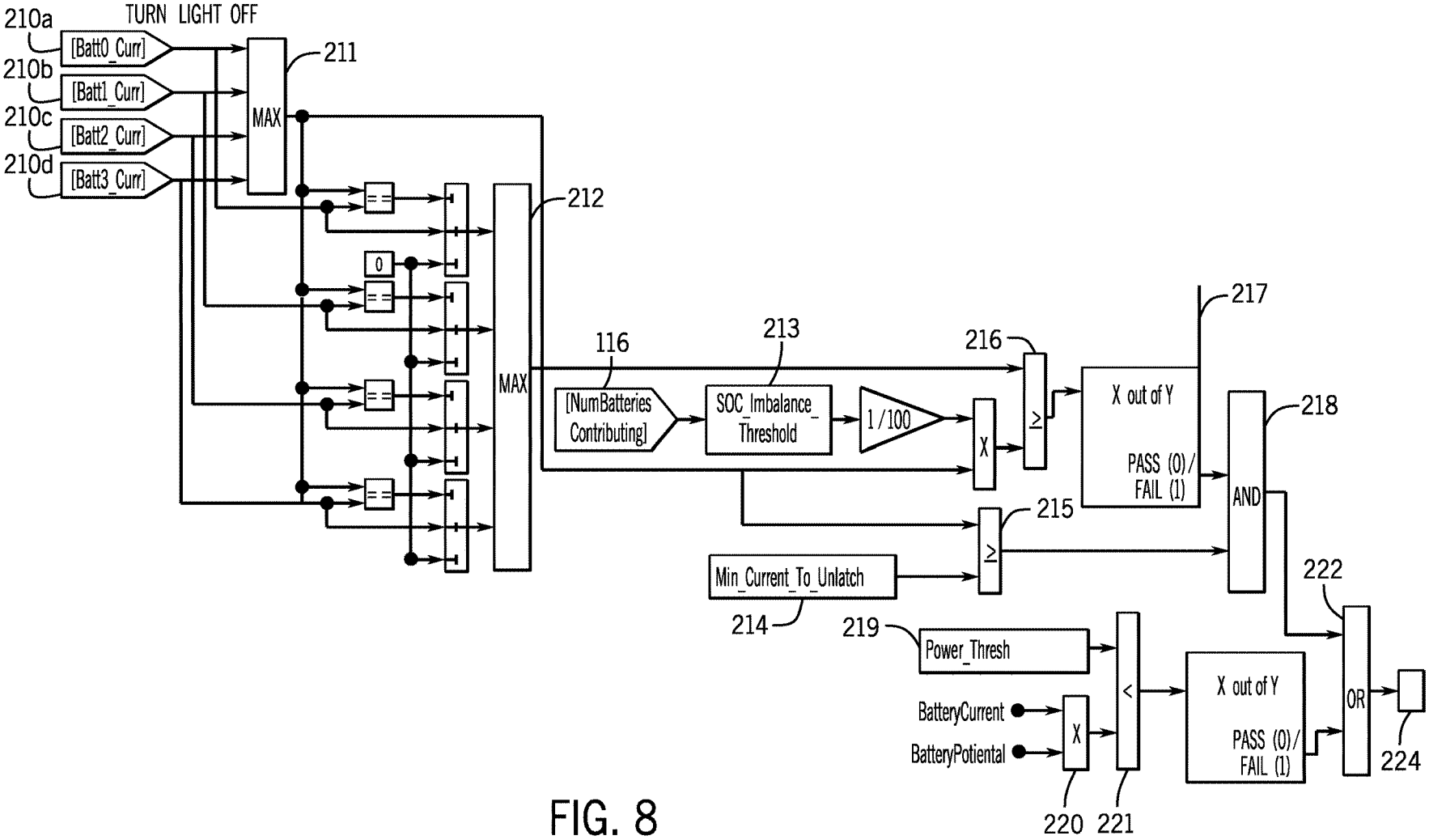
FIG. 8 is a control diagram illustrating exemplary steps for controlling an electric marine propulsion system and user interface therefor in accordance with the present disclosure to deactivate an imbalance limit alert.

FIG. 7 and FIG. 8 depict exemplary logic for activating and deactivating the imbalance limit alert. Starting in FIG. 7, activation of an imbalance limit alert is based on an active battery determination 200, which may utilize the output of logic steps described above for determining the system power limit. In one embodiment, the logic steps shown in FIGS. 4-5 may be used to determine whether a power imbalance exists between any subset of the plurality of batteries and/or calculating a system power limit. In other embodiments, alternative logic may be executed for detecting the imbalance and determining the system power limit. If the voltage is close enough between two or more batteries having the highest voltages, they will be able to contribute to the system power limit. In one embodiment, the number of active batteries is determined based on a corresponding input from each of the plurality of connected batteries, such determined via the inputs and logic described above at step 116 of FIG. 5. Alternatively, the active batteries may be determined at logic block 200 based on an assessment of the comparative voltage levels, or other charge levels, of each of the connected batteries 18*a*-*d*. If the battery voltages are sufficiently close to one another, such as within a threshold voltage difference or threshold percent difference of the highest voltage level, then each such battery will be deemed an active battery. Those batteries having a voltage that is more than a threshold less than the highest battery voltage out of the plurality of batteries are not active batteries and will remain inactive until the threshold voltage criterion is satisfied.

After the number of active batteries has been determined, logic step 201 compares the number of active batteries to the total number of batteries connected to the marine propulsion system. If the number of active batteries is less than the total number of batteries connected, meaning that one or more of the plurality of batteries 18*a-d* is inactive, then a positive, or true, Boolean value is transferred to logic step 202*a*, which is configured as a filter or other logic tool for introducing hysteresis to prevent the Boolean value indicating whether all batteries are active from changing. Batteries may become inactive momentarily, or for a short period, and thus logic step 202*a* is configured to output a steady value indicating whether all batteries are close enough in voltage and should be considered active for purposes of activating and/or deactivating the imbalance limit alert.

At step 203, the system power limit of the available active batteries (such the output of the system power limit module 110 according to the logic exemplified in FIGS. 4-5), is compared to the threshold power output of one or more drives of the marine propulsion system, or to some power threshold indicating that the propulsion system can be fully powered. The threshold power output may be based on the rated max power, which is the maximum power that the motor(s) 4 of the marine drive(s) 3 connected to the power storage system 16 consumes when producing its rated max output. To provide just one example, a three-horsepower motor may consume 2400 Watts of power when producing the max rated three-horsepower output. The power threshold 202*b* is set at or near the rated max power, such as a power value just below the rated max power or within a predetermined percentage of the rated max power, and thus the logic step 203 determines whether insufficient is available to generate full power (or very close to full power) output by the motor 4. If the system power limit is less than the power threshold, then the logic output at step 203 is true.

If the system power limit is less than the power threshold and less than all of the batteries are active, then the output of logic step 204 is true and the imbalance limit alert is activated. If, on the other hand, the system power limit is not less than the power threshold (meaning it is sufficient to fully power the motor) or if all batteries are active and contributing power to the system, then the imbalance limit alert is not activated. For example, a three-horsepower outboard with four batteries connected and only three active batteries may still be able to produce three horsepower. This means that, even though all of the batteries are not active, there is no imbalance limit because the current configuration is sufficient to meet the rated max power of the marine vessel 1. This also means there is no need to alert the user to an imbalanced state, so long as the rated max power is still achievable.

Regarding initial starting conditions and periods of battery assessment, some degree of hysteresis or other form of delay may be integrated to avoid false activation battery indicators. In another embodiment, a filter may similarly prevent such spikes in voltage readings during times such as initialization. For accuracy, the assessment of the batteries and whether the system has an imbalance limitation may be conducted when the system is in a steady state.

Referring now to FIG. 8, a control diagram containing exemplary steps for controlling an electric marine propulsion system and user interface to deactivate an imbalance limit alert is illustrated. An assessment of a functional marine propulsion system focuses on the determination of the maximum current. Similar to the inputs received in FIG. 7, deactivation of an imbalance limit alert may use information provided by the power limit module 110 as input. In one embodiment, logic steps similar to the logic shown in FIGS. 4-5 may be used to for detecting a power imbalance between a plurality of batteries and determining a system power limit Additional inputs from the system power limit determination, such the number of active batteries determined in step 116 of FIG. 5, may also be utilized.

The current output 210*a-d* of each battery 18*a-d* is assessed at logic block 211 to identify the highest current being outputted by the plurality of batteries 18*a-d*. The current outputs 210*a-d* are also assessed at logic block 212 to identify the second-highest current output. The highest current output is compared to the second-highest current output at step 216. In the depicted example, the output of step 216 indicates whether the second highest current is within a threshold current tolerance of the highest current output. Logic step 213 uses the current number of active batteries to determine the threshold current tolerance used for the comparison, which gets multiplied by the highest current output and provided to the comparison block 216. As the number of batteries increases, the threshold tolerance may be larger (i.e., permitting a greater difference in current outputs between the two highest currents). For example, if there are two active batteries the threshold current tolerance for the first and second maximum currents may only have to be within 50% of each other, or the second current maximum has to be within 50% of the first current maximum, whereas if there are three active batteries, the second maximum current might have to be within 20% of the first maximum current. In one embodiment, the control system 11 may use reference tables to compute the tolerance percentage for battery systems with different numbers of active batteries. In one embodiment, a lookup table may provide a comparison of the number of active batteries and the correlated tolerance percentage. Determination of current proximity between the maximum currents informs the control system 11 of whether the battery system is close enough to equilibrium that it can provide enough power for the marine vessel 1 to operate at full power.

At logic step 215, a minimum nominal current 214 is compared to the largest measured current from the power limit module 110 to ensure that the system is operating. If the largest measured current is above a minimum nominal current 214 and the second largest current is within tolerance of the largest current (which may be a filtered value as shown by filter 217), then the comparison at logic step 218 produces a positive Boolean indicating that the marine propulsion system is producing sufficient current to deactivate the imbalance limit alert.

At logic step 221, the total power output of the batteries is compared to a threshold power output 219, such as based on the rated max power for the at least one electric motor 4. As described above, threshold power output 219 may be based on the rated max power for the at least one electric motor, such as a value slightly below the rated max power or a predetermined percentage of the rated max power. A total power output of all the batteries 18*a-d* is calculated at step 220 as the total current outputted from the active batteries (e.g., the total of the current outputs 210*a-d*) and the average battery voltage of the active batteries. If the current output exceeds the total power output, a positive Boolean is outputted indicating that the power output of the system is sufficient to fully power the motor(s).

If the battery currents are sufficiently close or the motor is fully powered, and thus either outputs of blocks 218 or 219 are true, then logic step 222 outputs true, and logic block 224 outputs a signal to deactivate the imbalance limit alert.

One or more user interface devices are controlled based on activation and deactivation of the imbalance limit alert. The user interface may include a digital display screen or a gauge (such as an analog gauge with illuminable icons) to provide a visual imbalance alert when the imbalance limit alert is active. Alternatively or additionally, the user interface device(s) may include a speaker configured to generate an auditory alert, such as an alarm or other sound to alert the user to the fact that the system power limit is in place. Alternatively or additionally, the user interface device(s) may include a haptic device, such as on a throttle control input, configured to provide a haptic notification (e.g., a vibration pattern) of the system power limit due to the imbalance.

Figure 9A:
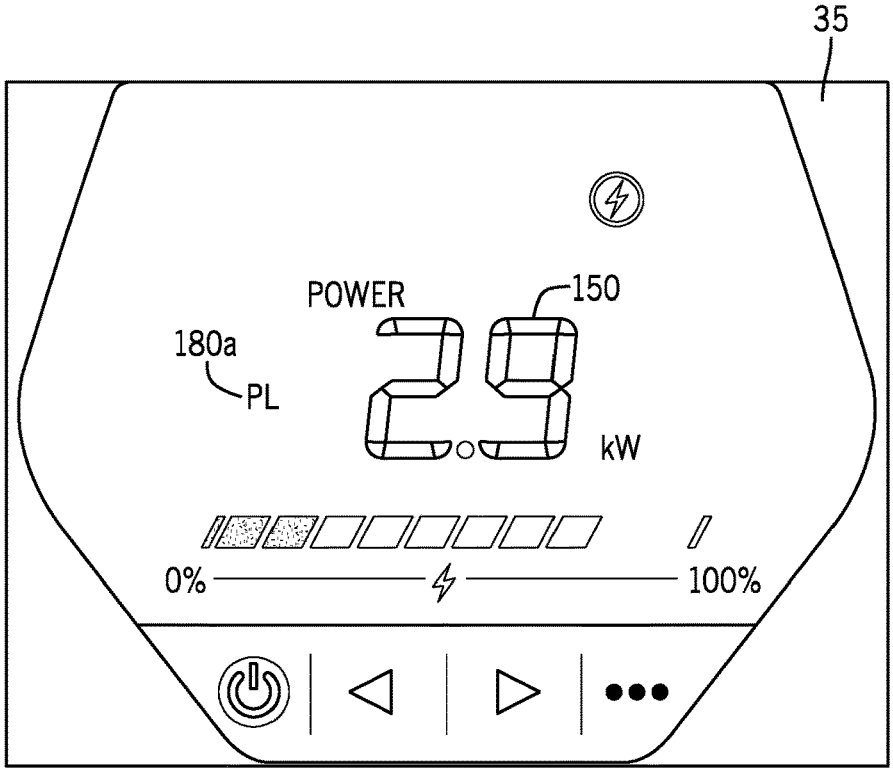
FIGS. 9A-C depict exemplary imbalance limit alerts according to the present disclosure.
Figure 9B:
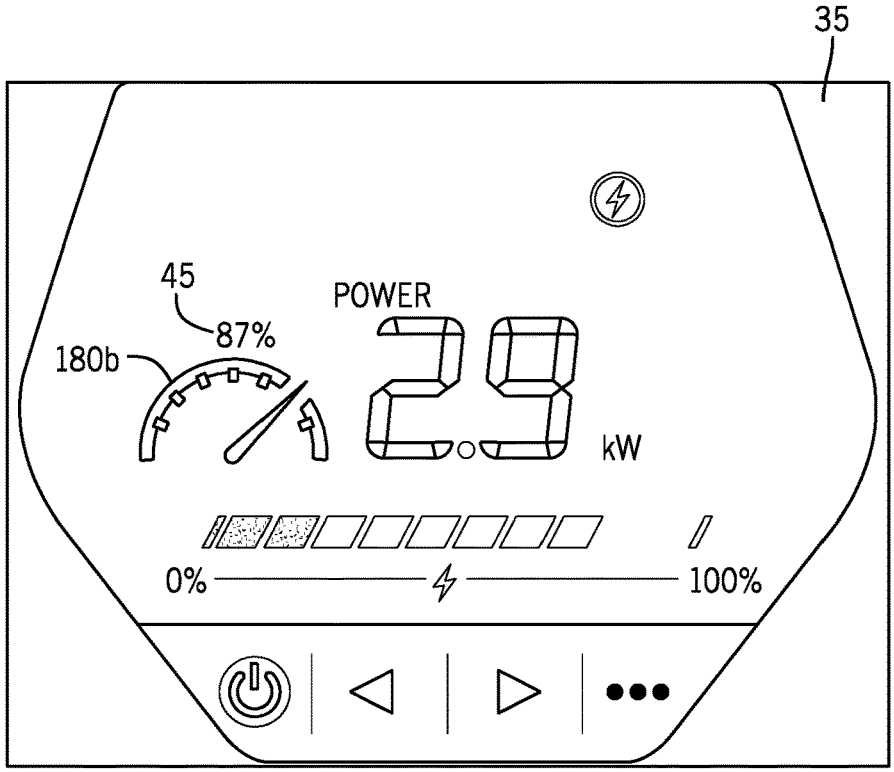
Figure 9C:
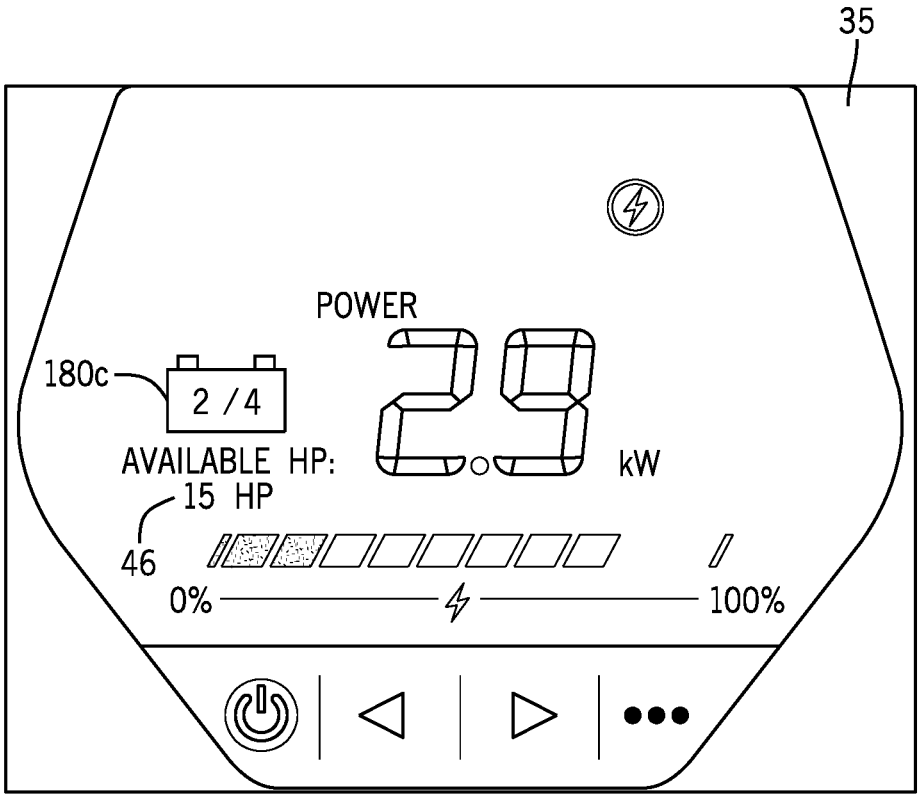

Referring now to FIGS. 9A-C, exemplary visual imbalance alerts are illustrated on exemplary user interfaces. The visual imbalance alert may be embodied in a plurality of ways, examples of which are depicted in FIGS. 9A-C which are merely exemplary. In some embodiments, there may be additional logic for controlling the visual imbalance alert that interfaces with the process outlined in FIGS. 7 and 8 that enables the visual imbalance limit alert to be displayed conditionally based on whether or not the imbalance alert Boolean is activated. In another embodiment, controlling the user interface device 35 based on the imbalance limit alert may include controlling a display device to generate a visual imbalance alert 180*a*, 180*b*, 180*c*. The visual imbalance alert 180*a*, 180*b*, 180*c* may be displayed in proximity to the power output 150 to provide context to the user regarding limitations created by the imbalance limit alert on the rated max power.

Embodiments of the display device may include the display 40, a gauge 45, 46, and/or a portion of a gauge 45, 46. In one embodiment, the gauge 45, 46 may comprise a numerical indicator or percentage. The gauges 45, 46 may provide insights into components of the marine propulsion system 2 that are affected by the imbalance limit alert. For example, the gauge may indicate what percentage of the rated max power is available for use or the amount of horsepower currently available. For example, the visual balance alert 180*a* may be a fixed element such as an LED indicator that may illuminate the display when the imbalance limit alert is active, such as the "PL" icon illustrated in FIG. 9A. In another embodiment, the visual imbalance alert may include illuminating an imbalance limit indicator light while the imbalance limit alert is active. The imbalance limit indicator light may consist of an element that is adapted to provide more information about the imbalance limit alert or the system power limit (as exemplified in FIGS. 9B and 9C). For example, an icon such as the visual imbalance alert 180*a*, 180*b*, 180*c* depicted in FIGS. 9B and 9C may become illuminated when the imbalance limit alert is active. Referring specifically to FIG. 9B, the control system 11 may be further configured to generate the visual imbalance alert 180 based on the system power limit to visually indicate the nature of the system power limit. Specific icons may be indicative to the user of what aspects of the marine propulsion system 2 are limited. As embodied in the figure, an icon of a gauge may indicate that the system power limit is less than the rated max power. In one embodiment, the visual imbalance alert 180*b* may be accompanied by a gauge 45 associated with the visual imbalance alert 180*b* that may indicate that only 87% of the rated max power is currently available to the user. In another embodiment depicted in FIG. 9C, the control system may generate the visual imbalance alert 180*c* resembling a battery when the triggering condition for the imbalance limit alert is that the number of active batteries is less than the total number of batteries, as explained in the description of FIG. 7. This visual imbalance alert 180*c* may indicate to the user how many active batteries are currently being used compared to the total number of available batteries. The icon may update to reflect an increased or decreased number of active batteries as the control system 11 refreshes the calculation when the marine vessel 1 is in a neutral state as described in FIG. 7.

Figure 10:
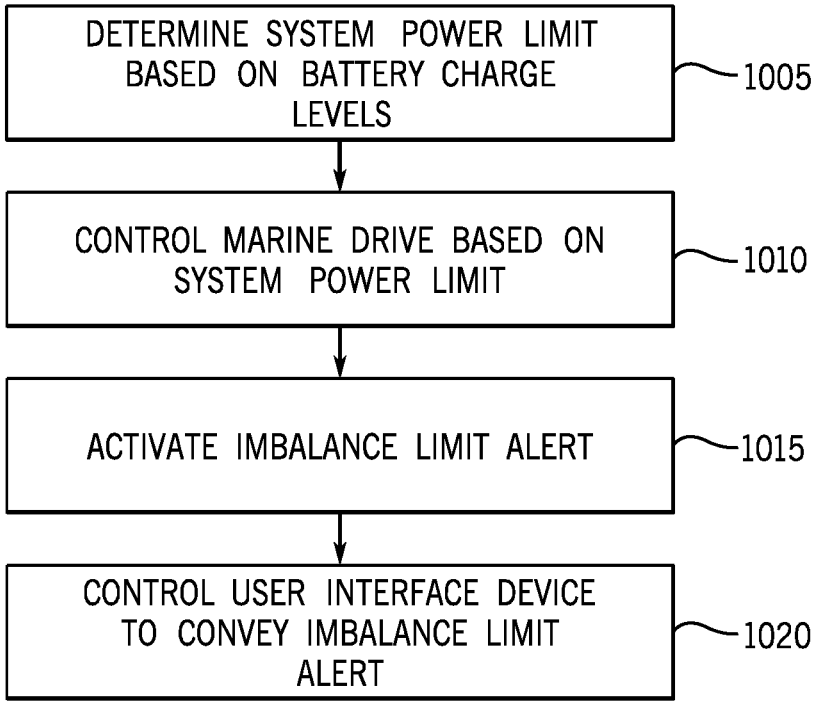
FIGS. 10-12 are flow charts depicting exemplary methods of controlling a user interface for an electric marine propulsion system according to the present disclosure.

Referring now to FIG. 10, a flow chart depicting an exemplary method of controlling a user interface for an electric marine propulsion system is illustrated. At 1005, the system power limit based on battery charge levels is determined. At 1010, the marine drive is controlled based on the system power limit. At 1015, an imbalance limit alert is activated. At 1020, the user device is controlled to convey the imbalance limit alert.

Figure 11:
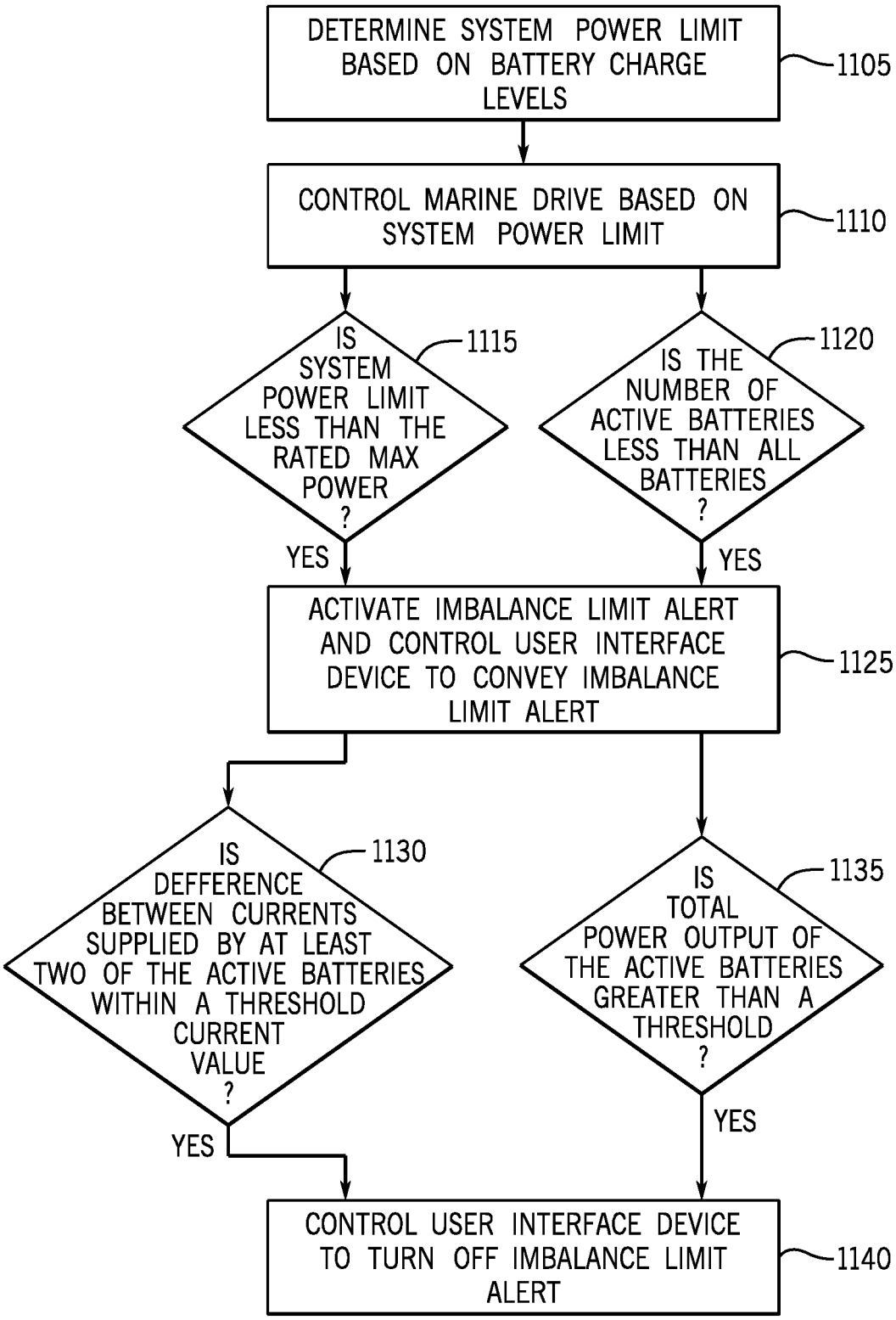

Referring now to FIG. 11, a flow chart depicting an exemplary method of controlling a user interface for an electric marine propulsion system is illustrated. At 1105, the system power limit is determined based on the battery charge levels. At 1110, the marine drive is controlled based on the system power limit. At 1115, the system power limit is evaluated to see if it is less than the rated max power. If it is, at 1120, the number of active batteries is compared to the total number of batteries to see is the number of active batteries is less than the total number of batteries. In one embodiment, the conditional evaluations notated by 1115 and 1120 may be alternatives or shared requirements to proceed to 1125. In other words, in alternative embodiments the logical connection between 1115 and 1120 may be treated as an OR logical process or as an AND logical process. If the requirement(s) is met, at 1125, the imbalance limit alert is activated and the user interface device is controlled to convey the imbalance limit alert.

The imbalance limit alert remains active until logic requirements for deactivation are met. At 1130, a difference is evaluated between the current supplied by at least two of the active batteries within a threshold current tolerance and, at 1135, the total power output of the active batteries is compared to a threshold. In one embodiment, the threshold may be based on rated max power, such as a value slightly less than or equal to the rated max power. If the total power output of the active batteries is greater than the threshold and/or the difference in currents supplied by at least two of the active batteries are within the threshold current tolerance of one another, then the user interface device is controlled to turn off the imbalance limit alert at 1140.

Figure 12:
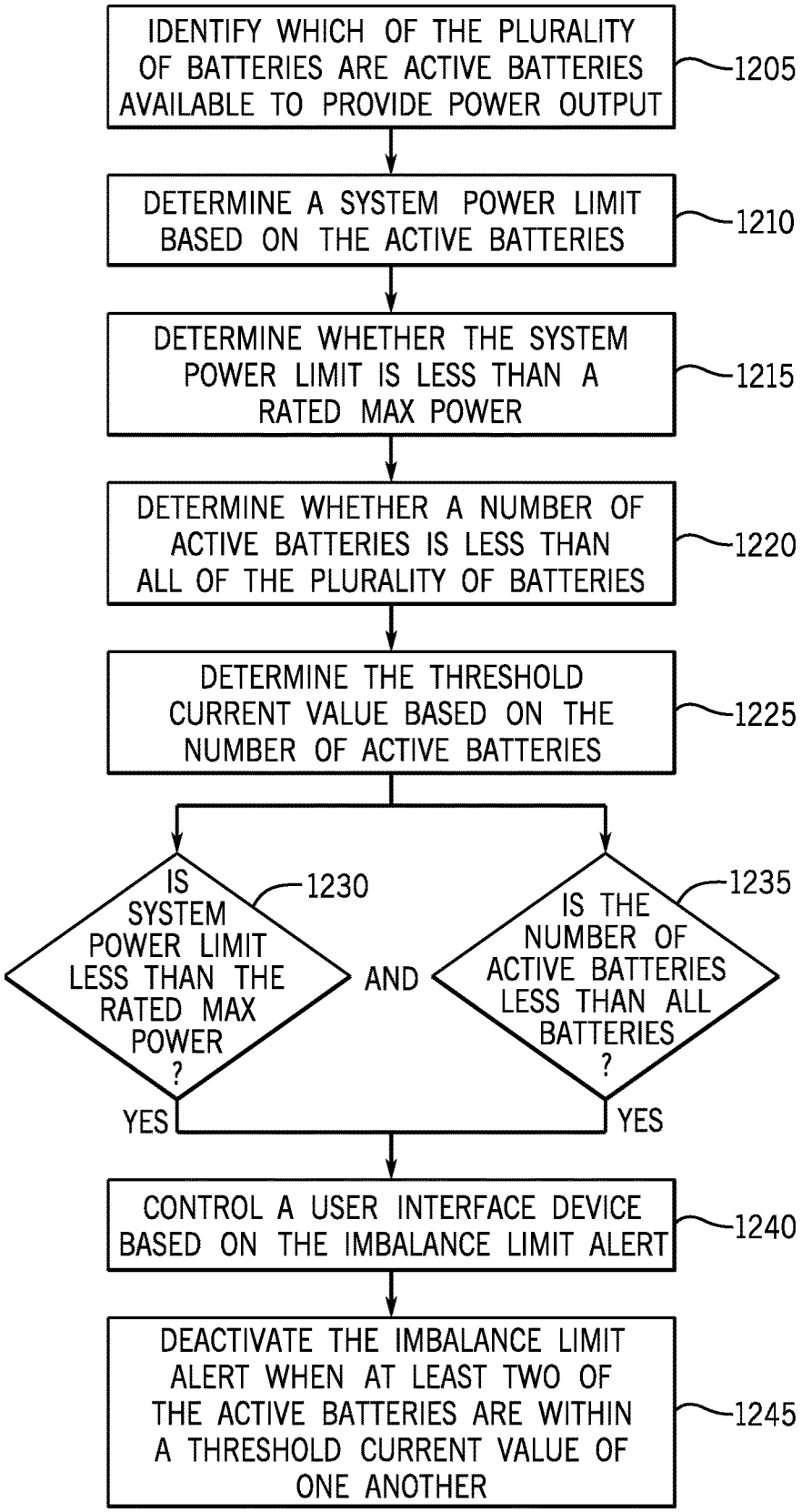

Referring now to FIG. 12, a flow chart depicting an exemplary method of controlling a user interface for an electric marine propulsion system is illustrated. At 1205, logic is executed to identify which of the plurality of batteries are active batteries available to provide power output. At 1210, the system power limit is determined based on the active batteries. At 1215, a comparison between the system power limit and the rated max power determines whether the system power limit is less than a rated max power. At 1220, it is determined whether a number of active batteries is less than all of the plurality of batteries. At 1225, a threshold current tolerance is determined based on the number of active batteries, such as using a table of threshold values indexed based on the possible number range of active batteries, as is described above. At 1230 and 1235, the system is evaluated to see if the system power limit is less than the rated max power and if the number of active batteries is less than the total number of all the batteries. If the answers to both questions are affirmative then, at 1240, a user interface device is controlled based on the imbalance limit alert, such as to provide a visual imbalance alert by illuminating an imbalance limit indicator light exemplified and described herein. The user interface continues providing the imbalance alert until the imbalance limit alert Boolean is deactivated. At 1245, the imbalance limit alert Boolean is deactivated when at least two or the active batteries are within a threshold current tolerance of one another, and thus the user interface is controlled to turn off the corresponding visual alert.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. An electric marine propulsion system configured to propel a marine vessel, the system comprising:

a power storage system comprising a plurality of batteries;

at least one electric motor powered by the power storage system and configured to rotate a propulsor to propel the marine vessel;

a control system configured to:

identify which of the plurality of batteries are active batteries available to provide power output to the at least one electric motor;

determine a system power limit based on the active batteries;

determine whether the system power limit is less than a threshold power output for the at least one electric motor;

determine whether a number of active batteries is less than all of the plurality of batteries;

if the system power limit is less than the threshold power output for the at least one electric motor and the number of active batteries is less than all of the plurality of batteries, activate an imbalance limit alert; and control a user interface device based on the imbalance limit alert.

2. The system of claim 1, wherein the threshold power output is based on a rated max power for the at least one electric motor.

3. The system of claim 1, wherein controlling the user interface device based on the imbalance limit alert includes controlling a display device to generate a visual imbalance alert.

4. The system of claim 3, wherein controlling the display device to generate the visual imbalance alert includes illuminating an imbalance limit indicator light while the imbalance limit alert is active.

5. The system of claim 3, wherein the control system is further configured to generate the visual imbalance alert based on the system power limit to visually indicate the system power limit or to generate the visual imbalance alert based on the number of active batteries to visually indicate the number of active batteries.

6. The system of claim 1, wherein the control system is configured to identify which of the plurality of batteries are the active batteries based on a charge level of each of the plurality of batteries.

7. The system of claim 6, wherein the control system is further configured to identify a maximum voltage level of the plurality of batteries, and wherein identifying the active batteries includes identifying which of the plurality of batteries has a voltage level within a threshold voltage value of the maximum voltage level.

8. The system of claim 1, wherein the control system is further configured to deactivate the imbalance limit alert when currents supplied by each of at least two of the active batteries are within a threshold current tolerance of one another.

9. The system of claim 8, further comprising determining the threshold current tolerance based on the number of active batteries.

10. The system of claim 8, wherein the threshold current tolerance is a percentage of a highest current output supplied by one of the active batteries.

11. The system of claim 1, wherein the control system is further configured to deactivate the imbalance limit alert when a total power output of the active batteries is at least the threshold power output.

12. The system of claim 1, wherein the control system is further configured to control the at least one electric motor so that the system power limit is not exceeded.

13. A method of controlling a user interface for an electric marine propulsion system comprising at least one controller, a plurality of batteries, and at least one electric motor powered by the plurality of batteries and configured to rotate a propulsor to propel a marine vessel, the method comprising:

identifying with the controller which of the plurality of batteries are active batteries available to provide power output to the at least one electric motor;

determining with the controller a system power limit based on the active batteries;

determining with the controller whether the system power limit is less than a threshold power output for the at least one electric motor;

determining with the controller whether a number of active batteries is less than all of the plurality of batteries;

if the system power limit is less than the threshold power output for the at least one electric motor and the number of active batteries is less than all of the plurality of batteries, activating with the controller an imbalance limit alert so as to control a user interface device based on the imbalance limit alert.

14. The method of claim 13, further comprising deactivating the imbalance limit alert with the controller when currents supplied by each of at least two of the active batteries are within a threshold current tolerance of one another.

15. The method of claim 14, further comprising determining with the controller the threshold current tolerance based on the number of active batteries.

16. The method of claim 14, wherein the threshold current tolerance is a percentage of a highest current output supplied by one of the active batteries.

17. The method of claim 14, further comprising deactivating the imbalance limit alert when a total power output of the active batteries is at least the threshold power output, wherein the threshold power output is based on a rated max power for the at least one electric motor.

18. A method of controlling a user interface for an electric marine propulsion system comprising a plurality of batteries and at least one electric motor powered by the plurality of batteries and configured to rotate a propulsor to propel a marine vessel, the method comprising:

determining a system power limit based on charge levels of each of the plurality of batteries;

controlling the at least one electric motor so that the system power limit is not exceeded;

activating an imbalance limit alert when the system power limit for the plurality of batteries is less than a threshold power output for the at least one electric motor and a number of active batteries available to provide power output to the at least one electric motor is less than all of the plurality of batteries; and controlling a user interface device based on the imbalance limit alert.

19. The method of claim 18, further comprising deactivating the imbalance limit alert when currents supplied by each of at least two of the active batteries are within a threshold current tolerance of one another or when a total power output of the active batteries is at least the threshold power output for the at least one electric motor.

20. The method of claim 18, wherein controlling the user interface device based on the imbalance limit alert includes controlling a display device to generate a visual imbalance alert.

21. The method of claim 20, further comprising generating the visual imbalance alert to visually indicate at least one of the system power limit and the number of active batteries.

* * * * *